US009552749B2

(12) United States Patent
Peterson

(10) Patent No.: US 9,552,749 B2
(45) Date of Patent: Jan. 24, 2017

(54) FIXED WINDOW BADGE

(71) Applicant: Contemporary, Inc., Manitowoc, WI (US)

(72) Inventor: James P. Peterson, Manitowoc, WI (US)

(73) Assignee: CONTEMPORARY, INC., Manitowoc, WI (US)

( * ) Notice: Subject to any disclaimer, the term of this patent is extended or adjusted under 35 U.S.C. 154(b) by 6 days.

(21) Appl. No.: 14/800,437

(22) Filed: Jul. 15, 2015

(65) Prior Publication Data

US 2015/0317921 A1 Nov. 5, 2015

Related U.S. Application Data

(63) Continuation of application No. 14/569,089, filed on Dec. 12, 2014, now Pat. No. 9,257,060, which is a continuation-in-part of application No. 13/842,496, filed on Mar. 15, 2013, now Pat. No. 8,925,222.

(60) Provisional application No. 61/614,888, filed on Mar. 23, 2012.

(51) Int. Cl.

| | |
|---|---|
| ***G09F 3/00*** | (2006.01) |
| ***G09F 3/20*** | (2006.01) |
| ***A44C 3/00*** | (2006.01) |

(52) U.S. Cl.

CPC ..... *G09F 3/207* (2013.01); *A44C 3/001* (2013.01)

(58) Field of Classification Search

CPC ..... A44C 3/001; A44C 3/002; G09F 3/207; G09F 3/12; G09F 3/18

See application file for complete search history.

(56) References Cited

U.S. PATENT DOCUMENTS

| | | | |
|---|---|---|---|
| 1,729,778 | A | 10/1929 | Hoag |
| 2,145,296 | A | 1/1939 | Draper et al. |
| 2,213,449 | A | 9/1940 | Mungen |
| 2,336,184 | A | 12/1943 | Mitchel |
| 2,341,467 | A | 2/1944 | Nedell |
| 2,458,349 | A | 1/1949 | Cross |
| 3,918,187 | A | 11/1975 | Vogele |
| 4,597,206 | A | 7/1986 | Benson |
| 5,212,899 | A | 5/1993 | Fandreyer |
| 5,522,163 | A | 6/1996 | Neugebauer |
| 5,588,240 | A | 12/1996 | Zilliox |
| 6,026,605 | A | 2/2000 | Tippett |
| 6,705,034 | B1 | 3/2004 | Cahill |
| 7,392,609 | B1 | 7/2008 | Miska |
| 7,406,792 | B2 | 8/2008 | Chang |

*Primary Examiner* — Cassandra Davis

(74) *Attorney, Agent, or Firm* — Michael Best & Friedrich LLP

(57) ABSTRACT

A badge for displaying indicia. The badge includes a base plate that defines a landing area that has a recessed portion. The badge also includes a top panel coupled to the base plate. The top panel defines an at least partially transparent portion. A strip is disposed between the base plate and the top panel and at least partially disposed underneath the at least partially transparent portion such that a portion of the strip is viewable through the at least partially transparent portion. The strip is removable from between the base plate and the top panel without removing the top panel from the base plate.

15 Claims, 5 Drawing Sheets

FIXED WINDOW BADGE

CROSS-REFERENCE TO RELATED APPLICATIONS

This application is a continuation of prior, co-pending U.S. patent application Ser. No. 14/569,089, filed Dec. 12, 2014, which is a continuation-in-part of U.S. patent application Ser. No. 13/842,496, filed Mar. 15, 2013, now U.S. Pat. No. 8,925,222, which claims the benefit of U.S. Provisional Patent Application No. 61/614,888, filed Mar. 23, 2012, the entire contents of each of foregoing patent applications being incorporated herein by reference.

FIELD OF THE INVENTION

This invention relates to a badge for displaying indicia and including provisions that allow for at least some of the indicia to be exchanged.

BACKGROUND

For convenience of expression, the term "badge" is used hereinafter to identify generically all similar devices, such as badges, business cards, ID cards, luggage tags, signs, key ring tags, and the like. The terms "graphics" or "graphic material," as used herein, includes text, artwork or both.

A large number of badges exist in today's marketplace for displaying identification or other indicia thereon. These typical badges include a display area with indicia thereon. Such indicia can include a wearer's name, an identification number, other words, names, symbols, graphics, illustrations or pictures. Badges are used in a variety of environments, such as service, retail, employment, military, educational, and meeting environments. They are most commonly attached to a wearer's clothing through a variety of means such as pins or adhesives.

SUMMARY

In some embodiments, a badge for displaying indicia includes a base plate that defines a landing area having a recessed portion. A top panel is coupled to the base plate. The top panel defines an at least partially transparent portion. Also, a strip is disposed between the base plate and the top panel and at least partially disposed underneath the at least partially transparent portion such that a portion of the strip is viewable through the at least partially transparent portion. The strip is removable from between the base plate and the top panel without removing the top panel from the base plate.

In some embodiments, a badge for displaying indicia includes a base plate that defines a landing area having a recessed portion. The badge also includes a fastener that is coupled to the base plate. The fastener is configured to secure the badge to a surface. A top panel is coupled to the base plate. The top panel defines an at least partially transparent portion. Also, a strip is disposed between the base plate and the top panel and at least partially disposed underneath the at least partially transparent portion such that a portion of the strip is viewable through the at least partially transparent portion. The strip is removable from between the base plate and the top panel without removing the top panel from the base plate.

In some embodiments, a badge for displaying indicia includes a base plate that defines a landing area having a recessed portion. The recessed portion extends along a longitudinal axis of the base plate. A top panel is coupled to the base plate. The top panel defines an at least partially transparent portion and includes the indicia such that the indicia are displayed above, below, or above and below the transparent portion. A strip is disposed between the base plate and the top panel and at least partially disposed underneath the at least partially transparent portion such that a portion of the strip is viewable through the at least partially transparent portion. The strip is removable from between the base plate and the top panel without removing the top panel from the base plate.

In some embodiments, a badge for displaying indicia comprises a base plate, a top panel coupled to the base plate and defining an opening, a strip disposed between the base plate and the top panel and at least partially disposed underneath the opening, and a window panel disposed between the base plate and the top panel and above the strip relative to the base plate, a portion of the window panel being viewable through the opening. The strip is removable from between the base plate and the top panel without removing the top panel from the base plate.

In some embodiments, a badge for displaying indicia comprises a base plate defining a landing area having a recessed portion, a top panel coupled to the base plate, the top panel defining an at least partially transparent portion, and a strip removably disposed between the base plate and the top panel and at least partially disposed underneath the at least partially transparent portion such that a portion of the strip is viewable through the at least partially transparent portion.

Before any embodiments of the invention are explained in detail, it is to be understood that the invention is not limited in its application to the details of construction and the arrangement of components set forth in the following description or illustrated in the above-described drawings.

The invention is capable of other embodiments and of being practiced or of being carried out in various ways.

DETAILED DESCRIPTION

Figure 1A:
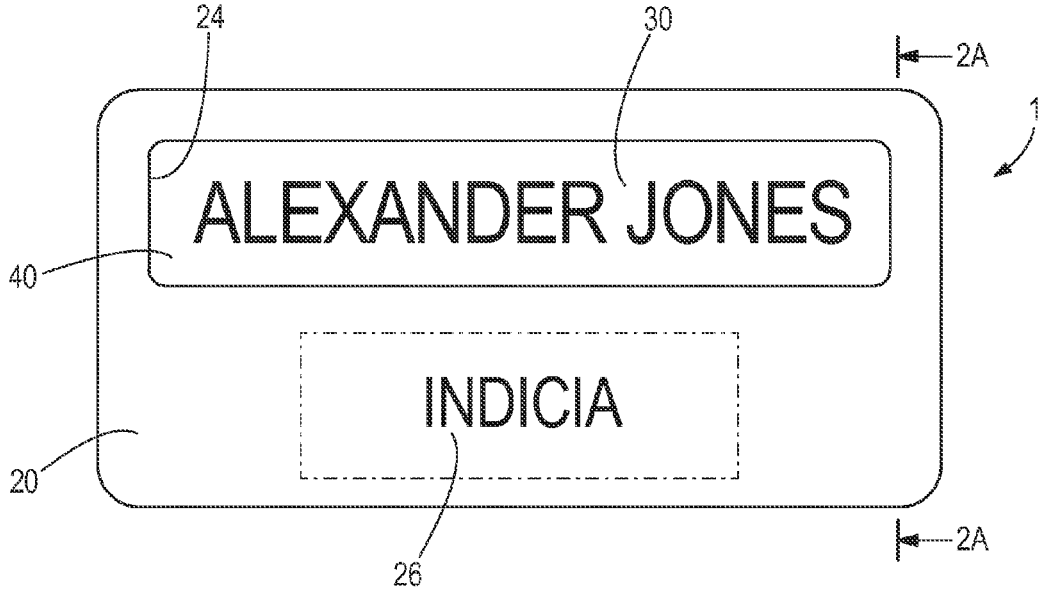
FIG. 1A is a plan view of a fixed window badge.
Figure 2A:
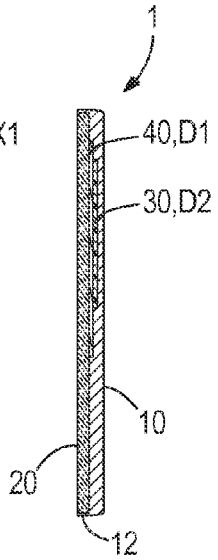
FIG. 2A is section view taken along line 2A-2A of FIG. 1A.
Figure 1B:
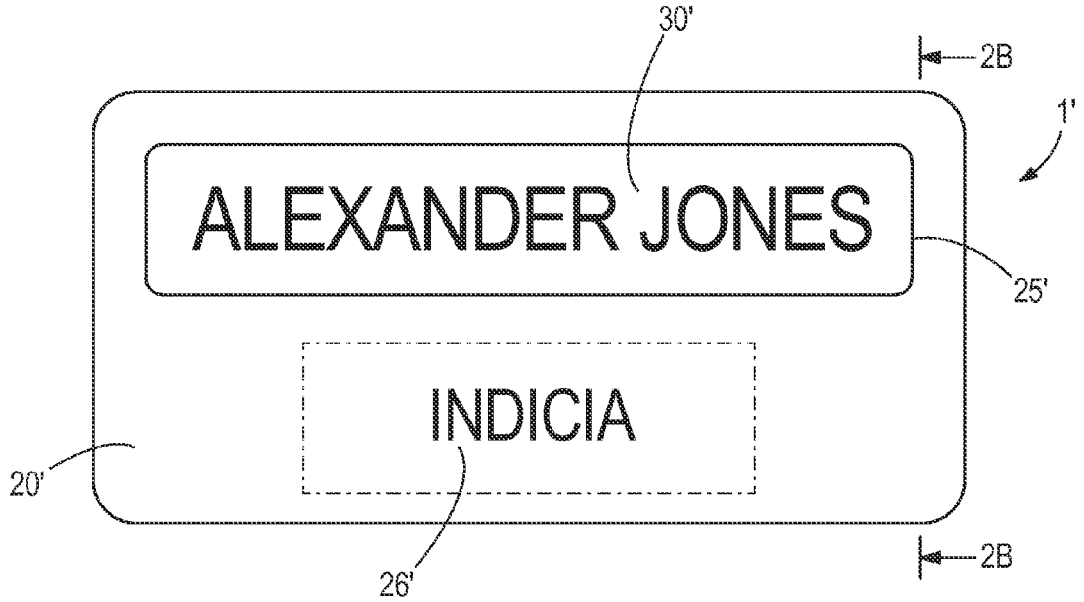
FIG. 1B is a plan view of a fixed window badge of an alternative embodiment.
Figure 3B:
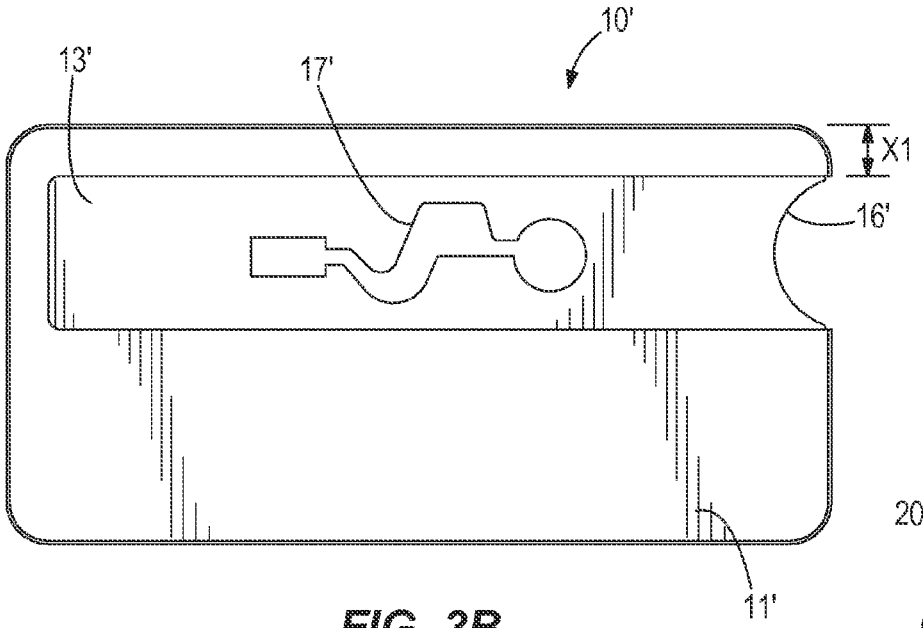
FIG. 3B is a plan view of a base plate for the badge of FIG. 1B.

FIGS. 1A and 2A illustrate a wearable badge 1 for displaying indicia. The badge 1 includes a base plate 10 and a top panel 20 coupled to the base plate 10. The top panel 20 defines an opening 24 through which an indicia-bearing strip 30 may be viewed. The strip 30 is sandwiched between the base plate 10 and the top panel 20, and is covered by a window panel 40 that is fixed between the base plate 10 and the top panel 20. The strip 30 is removable for changing the style or content of the information that is viewable through the opening 24.

The top panel 20 may include a permanent indicia portion 26 having a preprinted background. Alternatively, the permanent indicia portion 26 may be plain and in a condition to receive stickers or laminates including graphics or text designed on a personal computer, a picture taken by a digital camera, or the like. In alternative embodiments, background graphics may be printed on the top panel 20 and a semi-transparent laminate including, for example, names and titles of individuals can be applied over the background graphics. In the illustrated embodiment the indicia 26 is printed or positioned below the opening 24, although in other embodiments the indicia 26 may be printed or positioned above or above and below the opening 24.

Figure 3A:
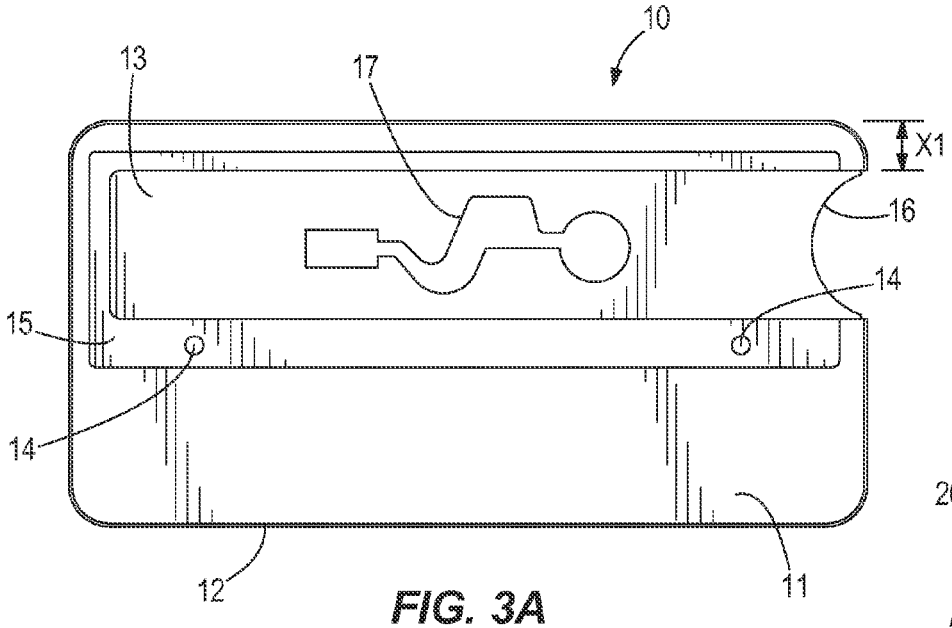
FIG. 3A is a plan view of a base plate for the badge of FIG. 1A.

FIG. 3A illustrates the base plate 10. The base plate 10 defines a longitudinal axis A and is generally rectangular in shape with rounded corners. However, the base plate 10 may have any suitable shape, including, but not limited to, circular, oval, or square. The base plate 10 may be made of plastic, metal, or other suitable material. The base plate 10 may also include a thumb cutout 16 along one side. The thumb cutout 16 may have a semi-circular or other suitable shape.

The base plate 10 may include a lip 12 disposed along a circumference of an upper surface (landing area) 11 of the base plate 10. The lip 12 forms a raised border of the base plate 10 and may have a height substantially equal to a thickness of the top panel 20. The lip 12 may alternatively have a flanged shape, extending outwardly from the base plate 10, or can be eliminated altogether, in which case the top panel 20 is carefully aligned with the base plate 10 during assembly, such as by a suitable fixture. Also, in some constructions, the top panel 20 can include a reverse bevel such that the angled bevel mates against the angled lip 12. In this way, when the top panel 20 is secured to the base plate 10 and the badge 1 is viewed from the front, the lip 12 is hidden by the top panel 20.

Figure 2B:
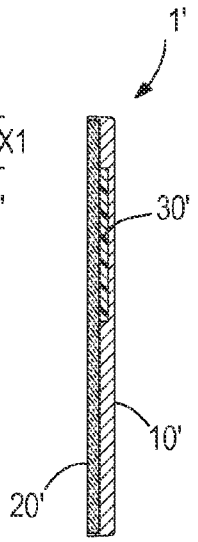
FIG. 2B is a section view taken along line 2B-2B of FIG. 1B.
Figure 1C:
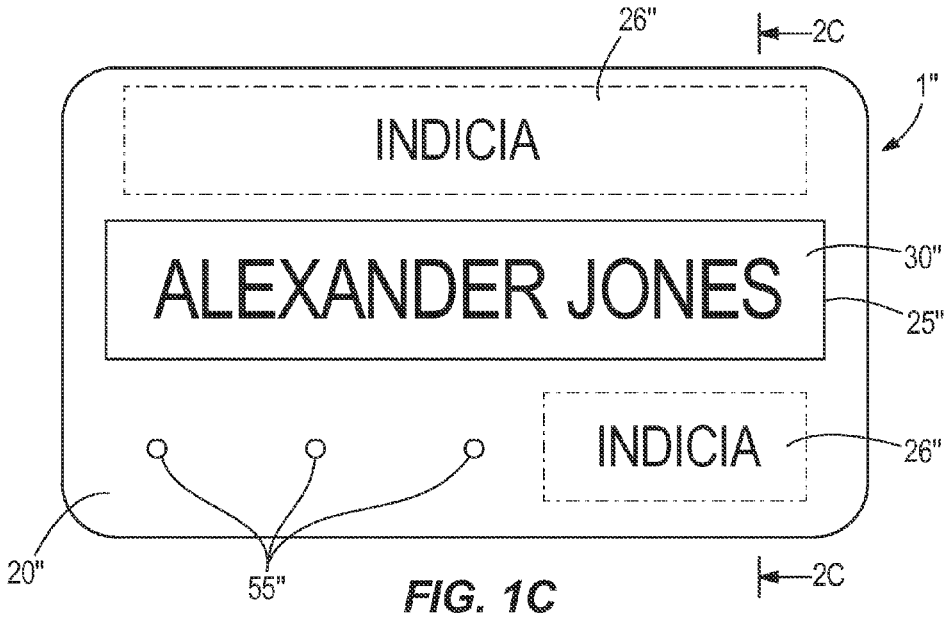
FIG. 1C is a plan view of a fixed window badge of another alternative embodiment.
Figure 3C:
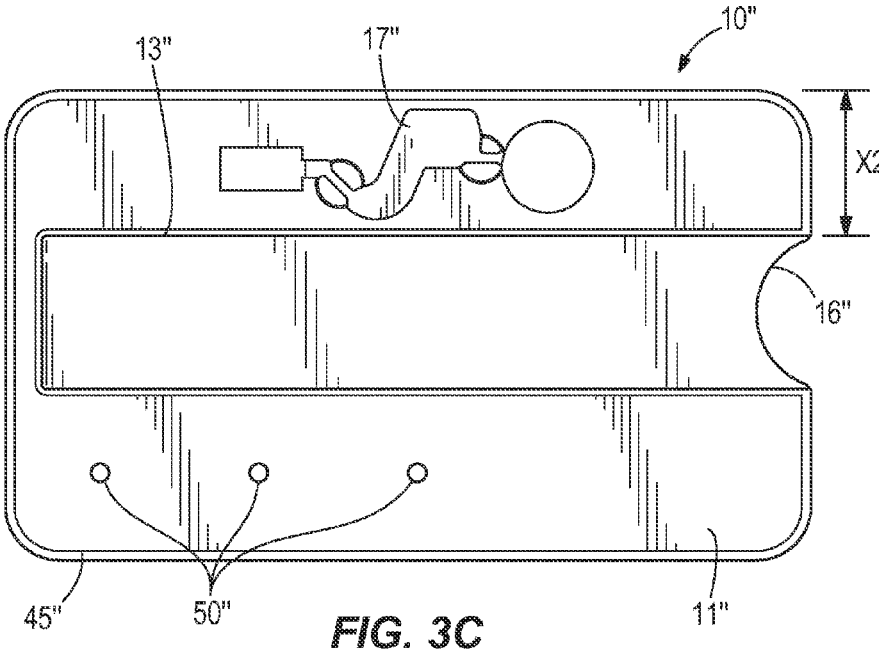
FIG. 3C is a plan view of a base plate for the badge of FIG. 1C.
Figure 2C:
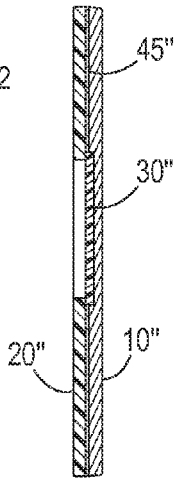
FIG. 2C is a section view taken along line 2C-2C of FIG. 1C.

As shown in FIG. 3A, the landing area 11 of the base plate 10 includes a first recessed portion 13 at a depth D1 from the landing area 11 of the base plate 10. The first recessed portion 13 extends parallel to and is offset from the longitudinal axis A by a distance X1. The shape of the first recessed portion 13 may be substantially similar to a shape of the base plate 10. In the illustrated embodiment, the first recessed portion 13 has a rectangular shape and is positioned in an upper half of the landing area 11. However, the first recessed portion 13 could also be centered vertically in the landing area 11 or formed in the bottom half of the landing area 11. FIG. 2 also shows the edges of the first recessed portion 13 being spaced from the lip 12. However, one or more edges of the first recessed portion 13 could abut the lip 12.

The first recessed portion 13 includes at least one post 14 extending from a surface of the first recessed portion 13 and positioned near a lower peripheral edge of the first recessed portion 13. The post 14 locates and fixes the window panel 40 with respect to the base plate 10, as further described below. The post 14 may be molded or pressed into the base plate 10 by any suitable method.

In the illustrated embodiment of FIGS. 1A-3A, the first recessed portion 13 includes two posts 14 substantially laterally aligned with one another and positioned toward either side of the first recessed portion 13. However, other arrangements and additional numbers of posts 14 are possible. For example, the posts 14 may be arranged near opposite edges of the first recessed portion 13 or may be disposed near all of the edges of the first peripheral portion 13. In an exemplary embodiment, each post 14 has a diameter of approximately 0.0625 inches and is approximately 0.1 inches tall.

With continued reference to FIG. 3A, the base plate 10 further includes a second recessed portion 15 at a depth D2 from the landing area 11 of the base plate 2. The second recessed portion 15 is formed within the first recessed portion 13 and has a shape substantially similar to the shape of the first recessed portion 13 and the base plate 10. The depth D2 is greater than the depth D1, thus, the base plate 10 generally has an increasing thickness moving outwardly from the second recessed portion 15 to the first recessed portion 13 to the non-recessed landing area 11. In an exemplary embodiment, the second recessed portion 15 is recessed approximately 0.027 inches below the landing area 11, and the first recessed portion 13 is recessed approximately 0.017 inches below the landing area 11.

FIG. 3A shows side edges of the second recessed portion 15 being spaced from edges of the first recessed portion 13 along three sides, and shows the second recessed portion 15 overlapping the first recessed portion 13 and extending to the lip 12 along the side adjacent to the thumb cutout 16. The cutout 16 is also offset from the longitudinal axis by the distance X1. Additional edges of the second recessed portion 15 could extend to the edges of the first recessed portion 13 or each of the edges of the second recessed portion 15 could be spaced from the edges of the first recessed portion 13.

The second recessed portion 15 is sized and shaped to receive the indicia-bearing strip 30. In this regard, the strip 30 may have a shape and size approximately equal to the size and shape of the second recessed portion 15, and a thickness approximately equal to a difference between the depths D1 and D2. As a result, the top of the strip 30 may be approximately flush with the first recessed portion 13 when the strip 30 is disposed in the second recessed portion 15.

Figure 6:
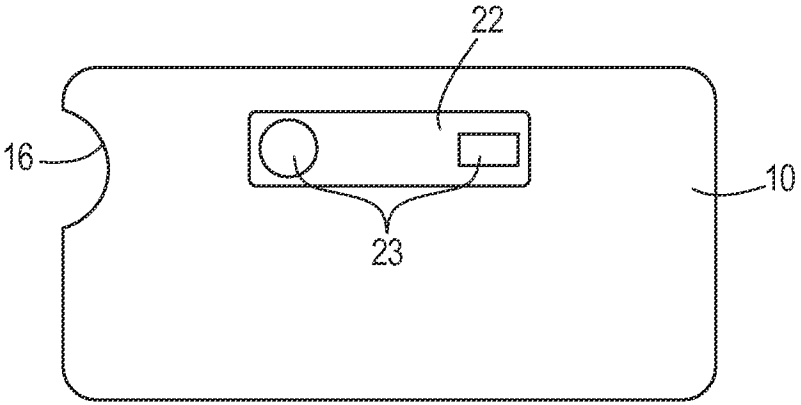
FIG. 6 is a rear plan view of the base plate of FIGS. 3A and 3B.

The base plate 10 of FIG. 6 is configured for use with a safety pin (not shown). Accordingly, the base plate 10 also includes a pin recess 17 extending therethrough, positioned within the second recessed portion 15, and configured to receive a pin for attaching the badge 1 to a person's clothing, luggage, or the like. A fixed portion of the safety pin extends through the pin recess 17 on the front side of the base plate 10 (see FIG. 3). A rear side (FIG. 6) of the back plate 10 includes a raised area 22 and two apertures 23, one rectangular and one round, through which opposing ends of the safety pin extend. The pin may be secured to the base plate 10, for example by heat-staking. The pin recess 17 may be centered vertically within the second recessed portion 15 and horizontally between the left and right sides of the badge 1 as illustrated in FIG. 3, or can be positioned substantially anywhere on the base plate 10.

FIGS. 1B-3B illustrate an alternative embodiment of the fixed window badge 1'. The badge 1' is similar to the badge 1, however, the lip 12, the window panel 40, the posts 14, the opening 24, and the second recessed portion 15 are omitted. The remaining reference numerals correspond to the reference numerals in the embodiment of FIGS. 1A-3A. In the embodiment of FIGS. 1B-3B, the top panel 20 includes a transparent portion 25' that at least partially overlays the strip 30'. Thus, the need for a separate transparent window panel is eliminated. The transparent portion 25' may be fully transparent or partially transparent, so long as the indicia printed on the strip 30' is at least partially visible through the transparent portion 25'. Because the window panel is eliminated, the alternative embodiment includes only a single recessed portion 13' with a depth substantially equal to a thickness of the strip 30'. In the illustrated embodiment the indicia 26 is printed or positioned below the opening transparent portion 25', although in other embodiments the indicia 26 may be printed or positioned above or above and below the transparent portion 25'. The remainder of the badge 1' is similar to that discussed above with respect to the badge 1.

FIGS. 1C-3C illustrate an alternative embodiment of the fixed window badge 1". The badge 1" is similar to the badge 1', however, the recessed portion 13" extends parallel to and is offset from the longitudinal axis A by a distance X2, which is greater than X1. In other words, the recessed portion 13" of FIGS. 1C-3C is centered more vertically on the back plate 10" than the recessed portions 13, 13' of the back plates 10, 10' of FIGS. 1A-3B. The cutout 16" is also offset from the longitudinal axis by the distance X2. Additionally, the pin recess 17" is positioned outside of the recessed portion 13". In the embodiment of FIGS. 1C-3C, the indicia 26" is illustrated both above and below the transparent portion 25" although like the embodiments of FIGS. 1A-3B, the indicia may be positioned only below the transparent portion 25". Of course, it is also within the scope of the invention to include indicia only above the transparent portion 25". Additionally, a liner 45" is positioned between the back plate 10" and the top plate 20". In particular, the liner 45" is adhesively coupled to the back plate 10". Furthermore, the back plate 10" includes one or more holes 50" and the top plate 20" includes one or more holes 55". The holes 50" of the back plate 10" are aligned with the holes 55" of the top plate 20". The aligned holes 50", 55" are configured to removably receive and secure lapel pins (not shown).

Figure 4:
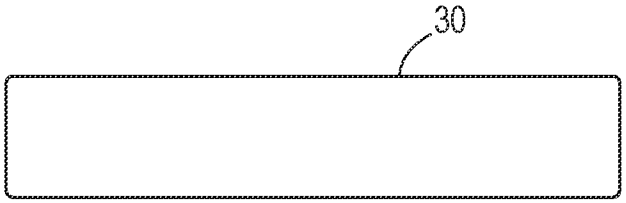
FIG. 4 is a plan view of an indicia strip for the badge of FIG. 1A, 1B, or 1C.

Referring also to FIG. 4, in some embodiments the strip 30 can be a paper card stock on which a person's name, company name, job title, or the like is printed. The strip 30 alternatively may be laminated, have a treated surface, or the like, and a pressure-sensitive adhesive on the back surface thereof so that it may be peeled off a release paper or other release material and stuck onto the second recessed portion 15. The front of the strip 30 may be coated or laminated to provide a surface for receiving any suitable printer ink, such as applied by either an ink jet or a laser printer. The strip 30 could also be a standard label printed from a labeling machine optionally including a pressure-release adhesive backing. The pressure-release adhesive backing can be removed to secure the strip substantially permanently in place, or can remain in place so that the strip 30 can be removed and exchanged as desired.

Figure 5:
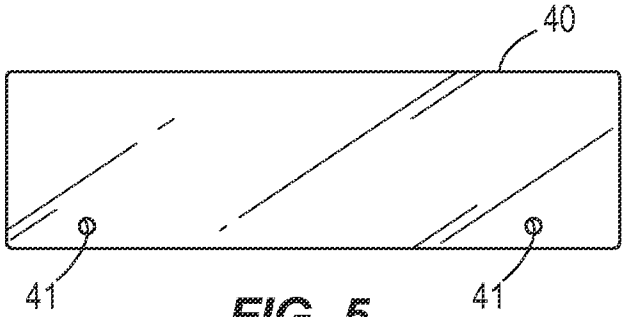
FIG. 5 is a plan view of a window panel for the badge of FIG. 1.

Referring also to FIG. 5, the window panel 40 is positioned within the first recessed portion 13 to cover and protect the strip 30. The window panel 40 is at least partially transparent, and may be fully transparent. As shown in FIGS. 3 and 5, the size, shape, and thickness of the window panel 40 approximately match a size, shape, and depth D1 of the first recessed portion 13 such that when the window panel 40 is positioned in the first recessed portion 13, the window panel 40 fits snugly within the first recess portion 13, while the top of the window panel 40 is approximately flush with the landing area 11 of the base plate 10.

The window panel 40 includes spaced-apart holes 41 adjacent the lower edge that are positioned to receive the posts 14 when the window panel 40 is positioned in the first recessed portion 13. The holes 41 have a diameter slightly larger than a diameter of the posts 14, such that the holes 41 may fit over and secure to the posts 14. In an exemplary embodiment, the holes 41 have a diameter of 0.04 inches.

Figure 7:
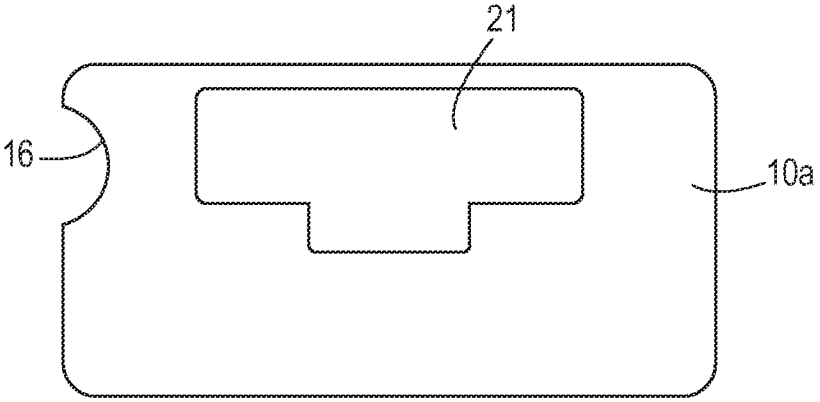
FIG. 7 is a rear plan view of an alternative base plate for the fixed window badge of FIGS. 1A and 1B.
Figure 9:
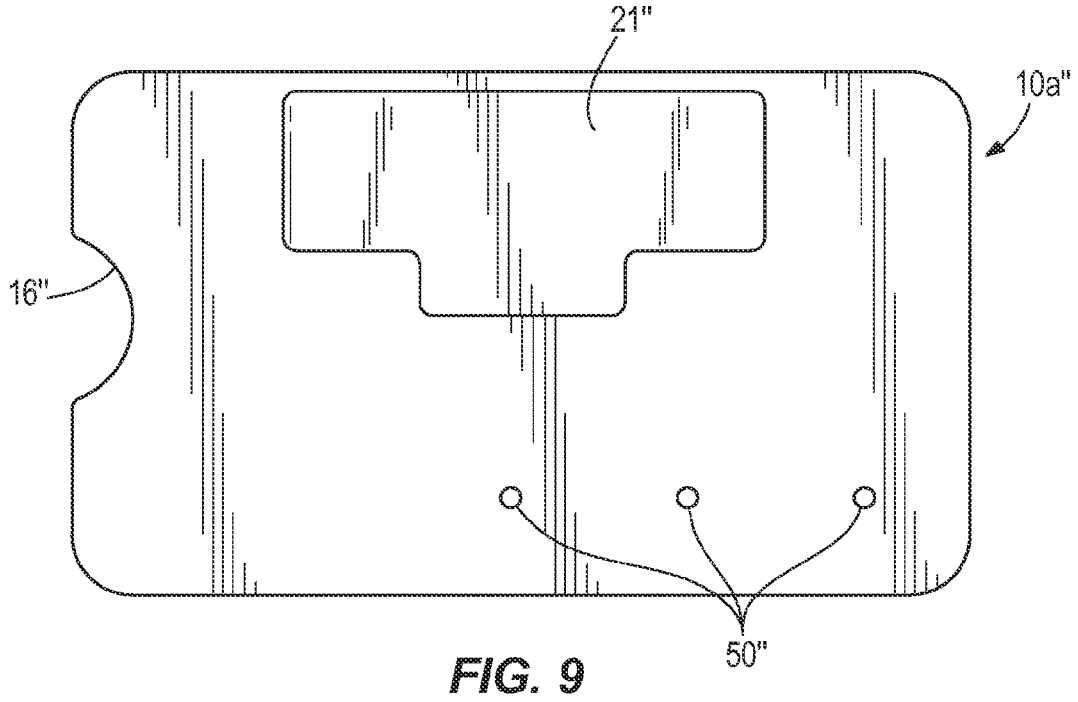
FIG. 9 is a rear plan view of an alternative base plate for the fixed window badge of FIG. 1C.

FIG. 7 shows an alternative embodiment of the base plate 10 and 10' and FIG. 9 shows an alternative embodiment of the base plate 10", each configured for use with a different type of fastener for attaching the badge to a surface.

The base plates 10*a*, 10*a*" of FIGS. 7 and 11 are configured for use either with a magnet (not shown) or with a bulldog clip (not shown). The base plates 10*a*, 10*a*" include a generally T-shaped recess 21, 21". The top portion of the recess 21, 21" is configured to receive a substantially rectangular magnet that may be secured in the recess 21, 21" by adhesive, heat-staking, or the like. The central portion of the recess 21, 21" is configured to receive a standard bulldog clip, which typically is provided on a substantially square backing. The bulldog clip can also be secured in the recess 21, 21" by adhesive, heat-staking, or the like. The recess 21, 21" and raised area 22, 22" are preferably centered horizontally between the left and right sides of the badge 1, 1', 1". In an exemplary embodiment, the recess 21, 21" has a depth of 0.02 inches.

Other configurations of the badge 1 are also possible and fall within the spirit and scope of the present invention. For example, rather than locating the posts 14 on the base plate 10, posts 14 could alternatively be provided on the top panel 20 and suitable openings could then be provided in the base plate 10. The posts 14 in the top panel 20 would extend through the holes 41 in the window panel 40 and into the openings provided in the base plate 10. The posts could then be heat staked, sonically welded, snap fit, or otherwise coupled to the base plate 10 to secure the assembly together. Still other configurations may include holes or recesses formed in the back surface of the top panel 20 for receiving the posts 14 of the base plate 10. In such configurations the posts 14 would be extended beyond the configuration shown in the figures so that the posts 14 extend into the holes or recesses formed in the back surface of the top panel 20. As discussed previously, the posts 14 could be heat staked, sonically welded, snap fit, and the like to the holes or recesses formed in the back surface of the top panel 20 to secure the assembly together. Like the badge 1" of FIGS. 1C-3C, the badges 1, 1' may also include additional features, such as the holes 50", 55" for lapel pins.

To assemble the badge 1, a safety pin (not shown) may be inserted into one of the apertures 23 on the rear side of the base plate 10 shown in FIG. 6. The fixed portion of the safety pin is extended through the pin recess 17 on the front side of the base plate 10 and may be secured to the base plate 10, for example by heat-staking. The window panel 40 is then positioned on the base plate 10, with the holes 41 of the window panel 40 in alignment with the posts 14 extending from the base plate 10. The holes 41 are then inserted through the posts 14 through a snap fit or other connection such that the window panel 40 is received by the first recessed portion 13 and overlies the second recessed portion 15. The top panel 20 may then be placed onto and coupled within the lip 12 of the base plate 10, with the opening 24 disposed over the window panel 40.

Figure 8:
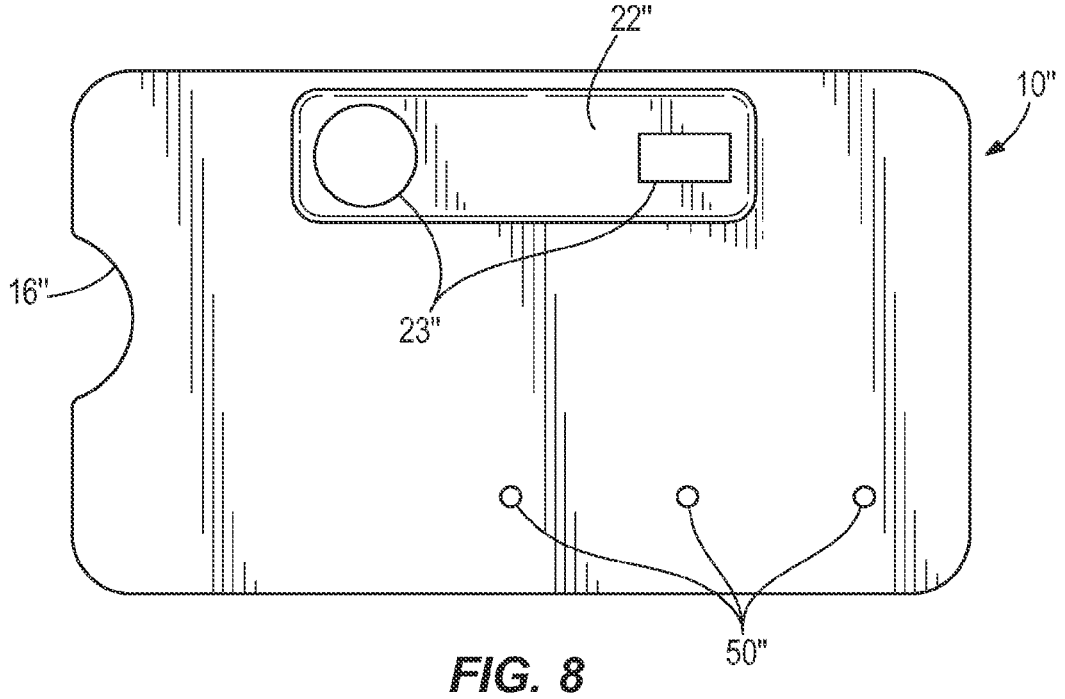
FIG. 8 is a rear plan view of the base plate for the fixed window badge of FIG. 3C.

To assemble the badges 1', 1", a safety pin (not shown) may be inserted into one of the apertures 23', 23" on the rear side of the base plate 10', 10" shown in FIGS. 6 and 8. The fixed portion of the safety pin is extended through the pin recess 17', 17" on the front side of the base plate 10', 10" and may be secured to the base plate 10', 10", for example by heat-staking. The top panel 20', 20" is then positioned over and coupled to the base plate 10', 10".

The strip 30 can be laterally inserted into and removed from the recessed portion 13, 13', 13" with aid of the thumb cutout 16, 16', 16". The thumb cutout 16, 16', 16" facilitates insertion and removal of the strip 30 by providing an area where the base plate 10 does not cover the rear surface of the strip 30. Thus, a user's thumb may be placed on the thumb cutout 16, 16', 16" for insertion or removal of the strip 30 through frictional engagement with the strip 30.

The items in FIGS. 1A-9 are shown as rectangular members for convenience of description. However, these configurations can vary. The illustrated rectangular members such as the base plates 10, 10', 10", recessed portions 13, 13', 13", 15, top panels 20, 20', 20", opening 24, strip 30, and window panel 40 may be of any suitable shape, including, but not limited to, circular, oval, or square.

The invention may be adaptable for sale in kit form. The specifics of the kit will, of course, depend upon customers' wants and needs. However, in general, the kit includes at least a base plate 10, top panel 20, a strip 30, a clip plate, and a clip.

Those who are skilled in the art will readily perceive modifications which are within the spirit and scope of the invention.

The invention claimed is:

1. A badge for displaying indicia, comprising:

a base plate defining a landing area having a recessed portion with an opening to the peripheral of the badge;

a top panel coupled to the base plate, the top panel defining an at least partially transparent portion;

a strip disposed between the base plate and the top panel and at least partially disposed underneath the at least partially transparent portion such that a portion of the strip is viewable through the at least partially transparent portion, the strip being removable from between the base plate and the top panel through the opening without removing the top panel from the base plate; and wherein the strip has a shape and size substantially equal to a size and shape of the recessed portion, and the strip has a thickness substantially equal to a depth of the recessed portion such that a top of the strip is substantially flush with the landing area when the strip is disposed in the recessed portion.

2. The badge of claim 1, further comprising a cutout that includes a portion of the base plate and the recessed portion such that a portion of the strip extends over the cutout when the strip is disposed in the recessed portion.

3. The badge of claim 1, wherein a portion of the recessed portion abuts edges of the base plate.

4. The badge of claim 1, wherein the shape of the recessed portion is substantially similar to a shape of the base plate.

5. The badge of claim 1, wherein the top panel includes the indicia, the indicia being displayed above, below, or above and below the transparent portion.

6. The badge of claim 1, wherein the recessed portion extends parallel to and offset from a longitudinal axis of the base plate.

7. A badge for displaying indicia, comprising:

a base plate defining a landing area having a recessed portion with an opening to the peripheral of the badge;

a top panel coupled to the base plate, the top panel defining an at least partially transparent portion:

a strip disposed between the base plate and the top panel and at least partially disposed underneath the at least partially transparent portion such that a portion of the strip is viewable through the at least partially transparent portion, the strip being removable from between the base plate and the top panel through the opening without removing the top panel from the base plate: and a fastener coupled to the base plate, the fastener being positioned either within the recessed portion or above the recessed portion.

8. A badge for displaying indicia, comprising:

a base plate defining a landing area having a recessed portion with an opening to the peripheral of the badge;

a fastener coupled to the base plate, the fastener configured to secure the badge to a surface;

a top panel coupled to the base plate, the top panel defining an at least partially transparent portion;

a strip disposed between the base plate and the top panel and at least partially disposed underneath the at least partially transparent portion such that a portion of the strip is viewable through the at least partially transparent portion, the strip being removable from between the base plate and the top panel through the opening without removing the top panel from the base plate; and wherein the strip has a shape and size substantially equal to a size and shape of the recessed portion, and the strip has a thickness substantially equal to a depth of the recessed portion such that a top of the strip is substantially flush with the landing area when the strip is disposed in the recessed portion.

9. The badge of claim 8, further comprising a cutout that includes a portion of the base plate and the recessed portion such that a portion of the strip extends over the cutout when the strip is disposed in the recessed portion.

10. The badge of claim 8, wherein a portion of the recessed portion abuts edges of the base plate.

11. The badge of claim 8, wherein the shape of the recessed portion is substantially similar to a shape of the base plate.

12. The badge of claim 8, wherein the fastener is one of a pin, a magnet, or a clip.

13. The badge of claim 8, wherein the top panel includes the indicia, the indicia being displayed above, below, or above and below the transparent portion.

14. The badge of claim 8, wherein the recessed portion extends parallel to and offset from a longitudinal axis of the base plate.

15. A badge for displaying indicia, comprising:

a base plate defining a landing area having a recessed portion with an opening to the peripheral of the badge;

a fastener coupled to the base plate, the fastener configured to secure the badge to a surface;

a top panel coupled to the base plate, the top panel defining an at least partially transparent portion;

a strip disposed between the base plate and the top panel and at least partially disposed underneath the at least partially transparent portion such that a portion of the strip is viewable through the at least partially transparent portion, the strip being removable from between the base plate and the top panel through the opening without removing the top panel from the base plate; and wherein the fastener is positioned either within the recessed portion or above the recessed portion.

* * * * *